US011213144B2

(12) United States Patent
Eid

(10) Patent No.: US 11,213,144 B2
(45) Date of Patent: Jan. 4, 2022

(54) SLEEP SUPPORT DEVICE

(71) Applicant: Albert Eid, Overland Park, KS (US)

(72) Inventor: Albert Eid, Overland Park, KS (US)

(73) Assignee: Albert Eid, Overland Park, KS (US)

( * ) Notice: Subject to any disclaimer, the term of this patent is extended or adjusted under 35 U.S.C. 154(b) by 36 days.

(21) Appl. No.: 16/814,946

(22) Filed: Mar. 10, 2020

(65) Prior Publication Data

US 2021/0282575 A1 Sep. 16, 2021

(51) Int. Cl.

| | |
|---|---|
| ***A47G 9/10*** | (2006.01) |
| ***A47C 16/00*** | (2006.01) |
| ***A47C 7/38*** | (2006.01) |

(52) U.S. Cl.

CPC ..... *A47G 9/1009* (2013.01); *A47C 7/383* (2013.01); *A47C 16/00* (2013.01); *A47G 9/1081* (2013.01); *A47G 2009/1018* (2013.01)

(58) Field of Classification Search

CPC ..... A47G 9/1009; A47G 9/1081; A47G 2009/1018; A47C 7/38; A47C 7/383; A47C 16/00

See application file for complete search history.

(56) References Cited

U.S. PATENT DOCUMENTS

| | | | | | |
|---|---|---|---|---|---|
| 2,120,310 | A * | 6/1938 | Duncan | A01N 1/00 | 27/13 |
| 4,773,106 | A * | 9/1988 | Toso | A47C 16/00 | 297/464 |
| 5,235,714 | A * | 8/1993 | Toso | A47C 16/00 | 5/633 |
| 6,151,734 | A * | 11/2000 | Lawrie | A47C 20/026 | 5/622 |
| 7,036,168 | B1 * | 5/2006 | Knickerbocker | A47G 9/1009 | 5/640 |
| 9,498,056 | B1 * | 11/2016 | Mills | B60N 2/806 | |
| 9,637,031 | B2 | 5/2017 | Hill et al. | | |
| 9,993,084 | B2 | 6/2018 | Trucco | | |
| 10,159,354 | B2 * | 12/2018 | Rayburn | A47C 7/383 | |
| 10,383,444 | B1 * | 8/2019 | Parkins | A45D 44/10 | |
| 2002/0045845 | A1 * | 4/2002 | Kruttke | A47C 16/00 | 602/32 |
| 2002/0050009 | A1 * | 5/2002 | Ley | A47C 16/00 | 5/657 |
| 2002/0100846 | A1 * | 8/2002 | Tinsley | A61G 13/0054 | 248/118 |
| 2004/0026979 | A1 * | 2/2004 | Haddon | B60N 3/00 | 297/393 |
| 2004/0262865 | A1 * | 12/2004 | Sigler | A47C 7/383 | 280/47.27 |

(Continued)

*Primary Examiner* — Eric J Kurilla

(57) ABSTRACT

A sleep support device that supports the upper body and head to allow comfortable sleep in a forward position during travel according to the present invention is disclosed. The sleep support device 100 that supports the upper body and head to allow comfortable sleep in a forward position during travel. The device 100 has locking hinges attached to a rigid structure. The locking hinges are positioned lateral to the hips bilaterally and connect the thigh to the upper body component on each side. Straps attached to the thigh component and the extension segment fix the device to the traveler's thigh. The upper body component allows the support of the torso and the head in a comfortable position during sleep.

5 Claims, 4 Drawing Sheets

(56) References Cited

U.S. PATENT DOCUMENTS

| | | | | |
|---|---|---|---|---|
| 2011/0078861 | A1* | 4/2011 | Colonello | A47C 16/00 5/657 |
| 2013/0232696 | A1* | 9/2013 | Halimi | A47G 9/1054 5/640 |
| 2014/0033439 | A1* | 2/2014 | Berhanu | A47C 7/383 5/640 |
| 2014/0312186 | A1* | 10/2014 | Meeh | A61H 37/00 248/118 |
| 2015/0001905 | A1* | 1/2015 | Jackow | B60N 2/806 297/397 |
| 2015/0274044 | A1 | 10/2015 | Kreppein | |
| 2016/0331126 | A1* | 11/2016 | Mills | A47C 16/00 |
| 2017/0112291 | A1* | 4/2017 | Trucco | A47C 16/00 |
| 2017/0202378 | A1* | 7/2017 | Scrimshaw | A47G 9/1081 |
| 2017/0215588 | A1* | 8/2017 | Trucco | A47G 9/10 |
| 2017/0354263 | A1* | 12/2017 | Houghson | F16M 11/28 |
| 2018/0084919 | A1* | 3/2018 | Rayburn | A47G 9/1027 |
| 2018/0132621 | A1* | 5/2018 | Scrimshaw | A47G 9/1081 |
| 2019/0200773 | A1* | 7/2019 | Komsky | A47G 9/1081 |
| 2019/0254435 | A1* | 8/2019 | Neu | A47C 7/383 |
| 2020/0008498 | A1* | 1/2020 | Sitzmann | A47C 20/022 |
| 2020/0337466 | A1* | 10/2020 | Zhu | A47G 9/1081 |
| 2021/0037982 | A1* | 2/2021 | Schwendeman | A47C 7/383 |

* cited by examiner

SLEEP SUPPORT DEVICE

TECHNICAL FIELD

This application relates in general to an article of manufacture for providing a sleep support device that supports the upper body and head to allow comfortable sleep in a forward position during travel.

BACKGROUND

Available sleep assist devices do not provide comfort during sleep on a plane, a train, a vehicle, or a bus. Most of these devices provide some support to the neck but remain inadequate in one or more ways. One prior device includes inflatable pillow that can be used to sleep in a forward position (for example Sleepy Cloud Travel Pillow™) but this pillow lacks good support and adaptability to body habitus. Another prior support device is called face cradle that can be strapped to the seat in the back and can provide support to the upper chest and face. This device is not adequate because it puts too much pressure on a traveler's neck and it is not steady.

The present invention attempts to address the existing limitations in supporting a traveler attempting to sleep with a sleep support device according to the principles and example embodiments disclosed herein.

SUMMARY

In accordance with the present invention, the above and other problems are solved by providing a sleep support device that supports the upper body and head to allow comfortable sleep in a forward position during travel.

In one embodiment, the present invention is a sleep support device that supports the upper body and head to allow comfortable sleep in a forward position during travel. The sleep support device includes a pair of locking hinges attached to a rigid structure consisting of: a pair of thigh supports having an inner end coupled to the pair of locking hinges, a pair of extension segments coupled to an outer end of the pair of thigh supports, and a padded rigid frame that extends to the shoulders to provide upper body support and then takes the form of an arch to support the head.

The great utility of the invention is that an article of manufacture may provide a sleep support device for in supporting a traveler attempting to sleep within a spatial confines of aircraft, train, bus, and vehicle seats.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and specific embodiment disclosed may be readily utilized as a basis for modifying or designing other structures for carrying out the same purposes of the present invention.

It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Referring now to the drawings in which like reference numbers represent corresponding parts throughout.

DETAILED DESCRIPTION

Figure 1:
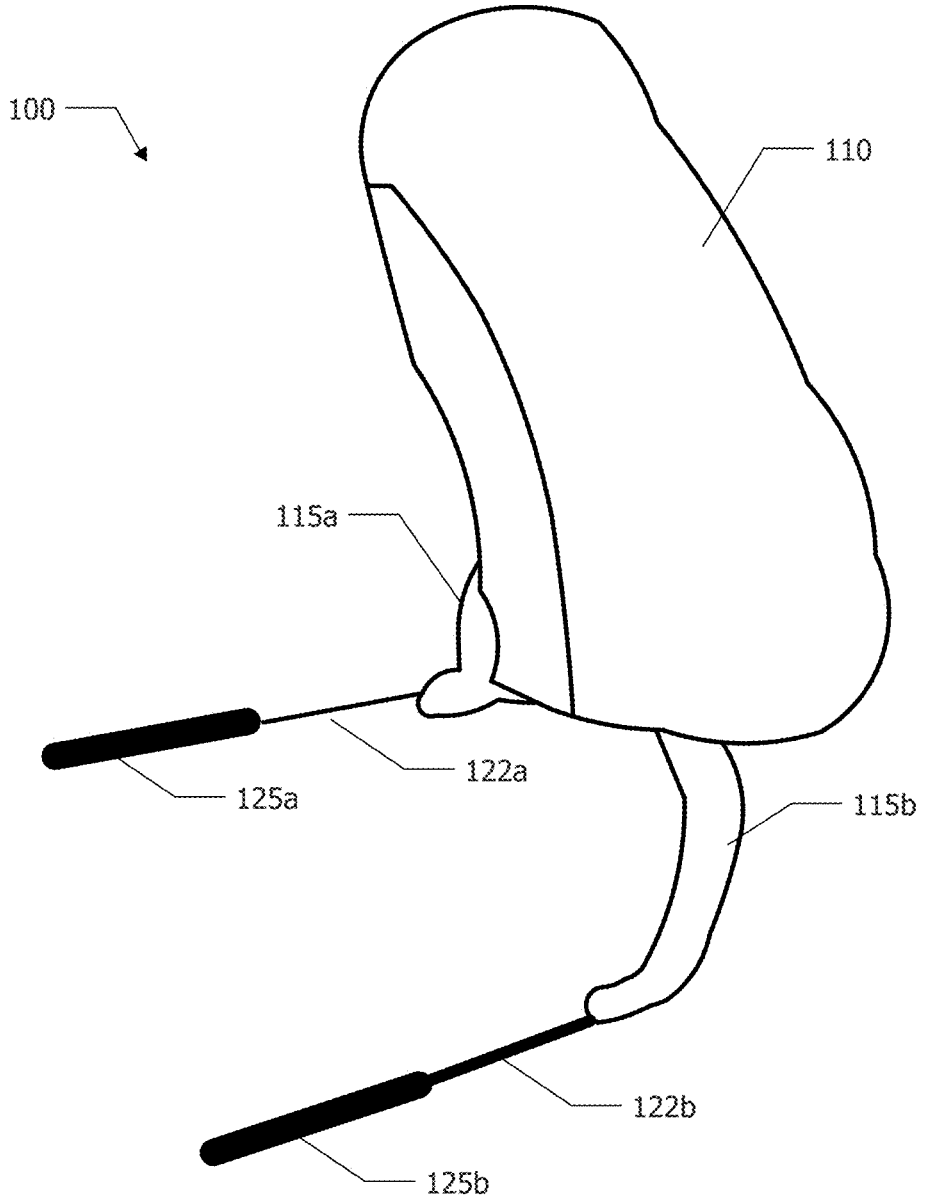
FIG. 1 illustrates one potential embodiment of an article of manufacture for providing a sleep support device that supports the upper body and head to allow comfortable sleep in a forward position during travel according to the present invention.

This application relates in general an article of manufacture for providing a sleep support device that supports the upper body and head to allow comfortable sleep in a forward position during travel. Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. Thus, for example, reference to "a needle" includes reference to one or more of such needles and "etching" includes one or more of such steps. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps, or components but do not preclude the presence or addition of one or more other features, steps, or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "50-250 micrometers should be interpreted to include not only the explicitly recited values of about 50 micrometers and 250 micrometers, but also include individual values and sub-ranges within the indicated range. Thus, included in this numerical range are individual values such as 60, 70, and 80 micrometers, and sub-ranges such as from 50-100 micrometers, from 100-200, and from 100-250 micrometers, etc. This same principle applies to ranges reciting only one numerical value and should apply regardless of the breadth of the range or the characteristics being described.

As used herein, the term "about" means that dimensions, sizes, formulations, parameters, shapes and other quantities and characteristics are not and need not be exact, but may be approximated and/or larger or smaller, as desired, reflecting tolerances, conversion factors, rounding off, measurement error and the like and other factors known to those of skill. Further, unless otherwise stated, the term "about" shall expressly include "exactly," consistent with the discussion above regarding ranges and numerical data.

The term "user" and "traveler" refers to an entity, e.g. a human, that is a passenger on an aircraft, bus, train or vehicle using a sleep support device according to the present invention in order to bring about a desired effect or outcome, particularly provide the user with body support while sleeping in a seat. For such a user, the terms "user" and "traveler" may be used herein interchangeably.

In general, the present disclosure relates general an article of manufacture for providing a sleep support device that supports the upper body and head to allow comfortable sleep in a forward position during travel. To better understand the present invention, FIG. 1 represents one potential embodiment of general an article of manufacture for providing an OptumS sleep support device 100 that supports the upper body and head to allow comfortable sleep in a forward position during travel.

OptumS consists of a sleep support device 100 that supports the upper body and head to allow comfortable sleep in a forward position during travel. The device 100 consists of 2 locking hinges 120 *a-b* attached to a rigid structure consisting of the upper body component 115*a-b* and 110, and the thigh component 122*a-b* and 125*a-b*. The locking hinges 120*a-b* are positioned lateral to the hips bilaterally. The locking hinges 120*a-b* operate within 0° to 90° range. In a sleep mode, the hinges 120*a-b* are locked at approximately 70°.

The thigh component 122*a-b* of the device 100 is made of metal and plastic material and is positioned lateral and fixated to the thighs through two padded Velcro straps 132*a-b*. An extension of this segment 125*a-b* allows an adjustment of the length of the thigh component. 125*a-b* is fixated to the thighs through an additional two padded Velcro straps 135*a-b*. Another curved and rigid extension could wrap around and underneath the distal thigh along with the pad and the Velcro strap to relieve the pressure on the thighs during sleep.

The upper body component is made of a rigid frame 115*a-b* padded with foam and extends towards the shoulders to provide upper body support and then takes the form of an arch 110 to support the head (forehead and cheeks). The lower part of the upper body component 110 has a telescoping locking mechanism to allow adjustments. The length of the upper body and thigh components can be adjusted to fit the body habitus and to reduce length and storage space.

A first pair of straps 132*a-b* wrap around the traveler's thighs to hold the supporting thigh components 122*a-b* adjacent to the thighs while the traveler sleeps. By coupling these straps 132*a-b* to the traveler in this manner, the device 100 is held stable even though the traveler falls asleep.

An optional strap could connect the locking hinges 120*a-b* posteriorly and provide support behind the traveler's lower back to maintain the device 100 in its position even in a standing posture.

The entire system folds at the level of the locking hinges 120*a-b* (hinge locked at) 0°, at the middle section of the arch supporting the forehead, and the upper body component, which reduces its size (around 40 cm×10 cm) and makes it easy to store.

A different version of this device could be mounted on a plane, train, or bus seat to allow sleep during travel. In this situation, the lower component of the device will be attached to the seat on both sides instead of being attached to the passenger's thighs.

The device can be adjusted to the body habitus (size and length of the upper body). It is very steady and provides good support to the entire upper body (torso, neck and head).

Figure 2:
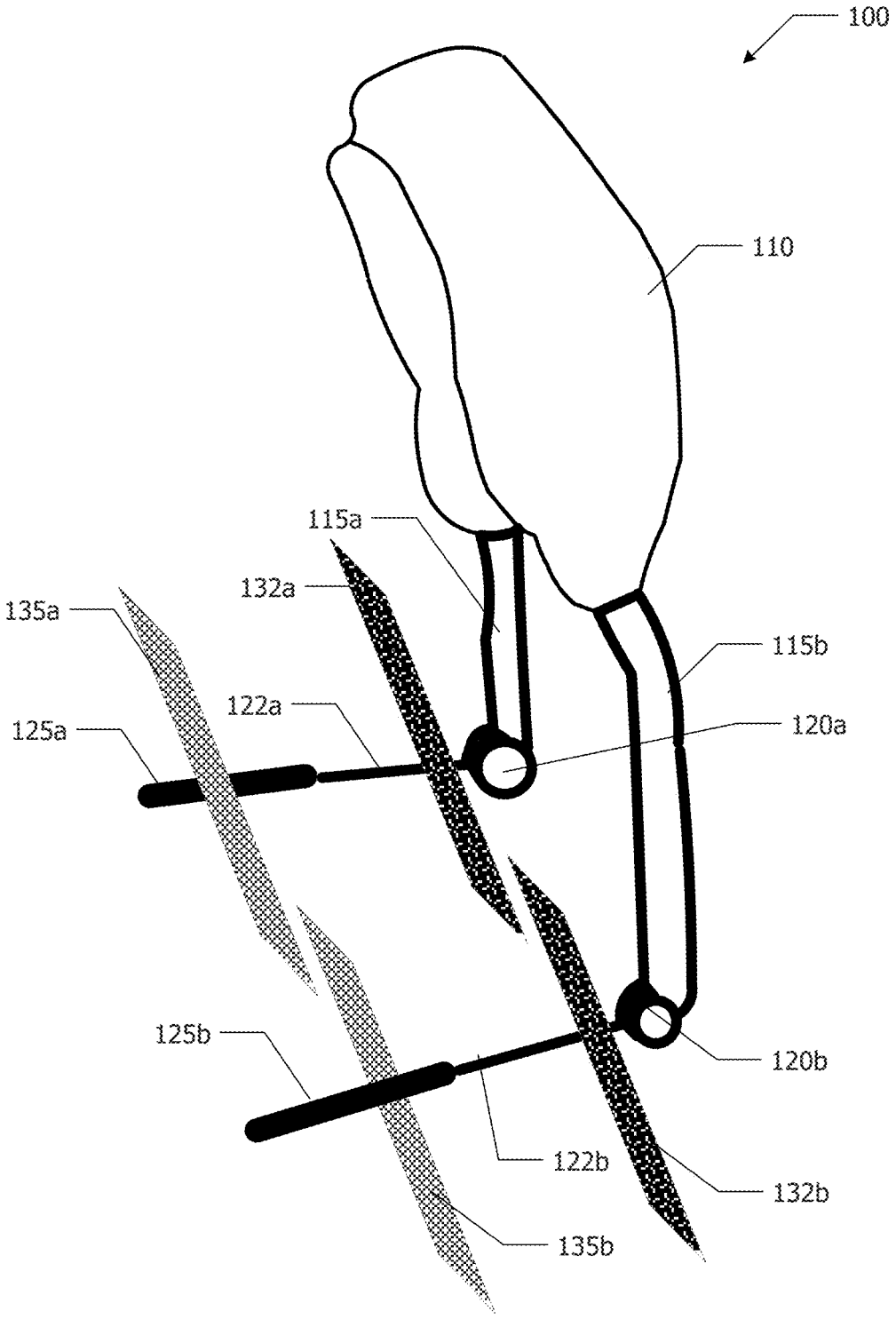
FIG. 2 illustrates another potential embodiment of a side view of a sleep support device that supports the upper body and head to allow comfortable sleep in a forward position during travel according to the present invention.

FIG. 2 illustrates another potential embodiment of a side view of a sleep support device that supports the upper body and head to allow comfortable sleep in a forward position during travel according to the present invention. In the embodiment of FIG. 2, the straps 132*a-b* and 135*a-b* are shown attached to the thigh component 122*a-b* and 125*a-b*, respectively.

Figure 3:
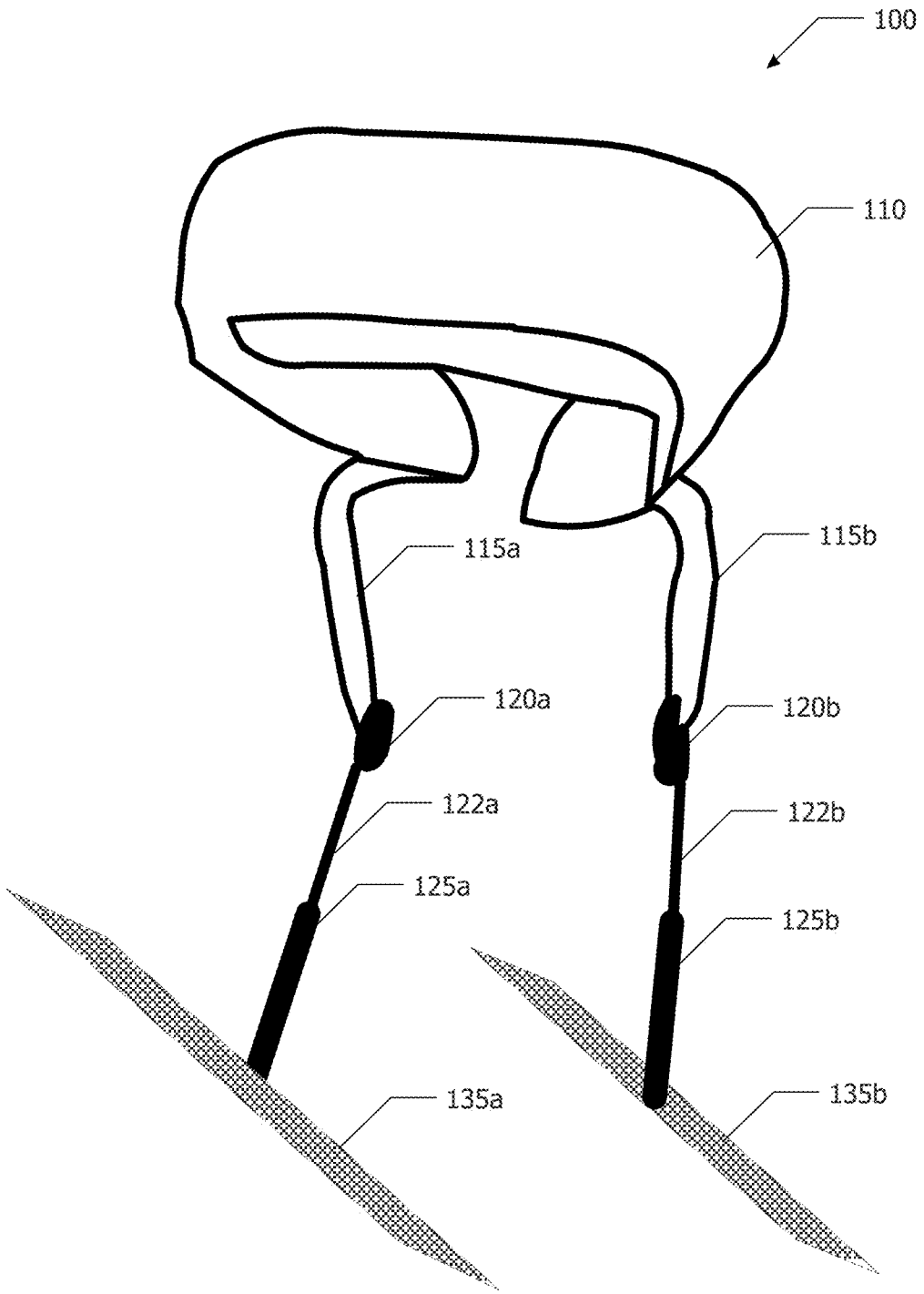
FIG. 3 illustrates yet another potential embodiment of a traveler's front view of a sleep support device that supports the upper body and head to allow comfortable sleep in a forward position during travel according to the present invention.

FIG. 3 illustrates yet another potential embodiment of a traveler's front view of a sleep support device that supports the upper body and head to allow comfortable sleep in a forward position during travel according to the present invention. This view of the device 100 is shown in which the user has coupled the device 100 to his or her body with the thigh components 122*a-b* and 125*a-b* running along the user's thighs with the rigid frame 115*a-b* along the user's torso. The arching upper body support 110 passes in front of the user at the head level. In the embodiment of FIG. 3, the straps 135*a-b* are shown attached to the outer end of the extension segment 125*a-b* of the thigh component.

Figure 4:
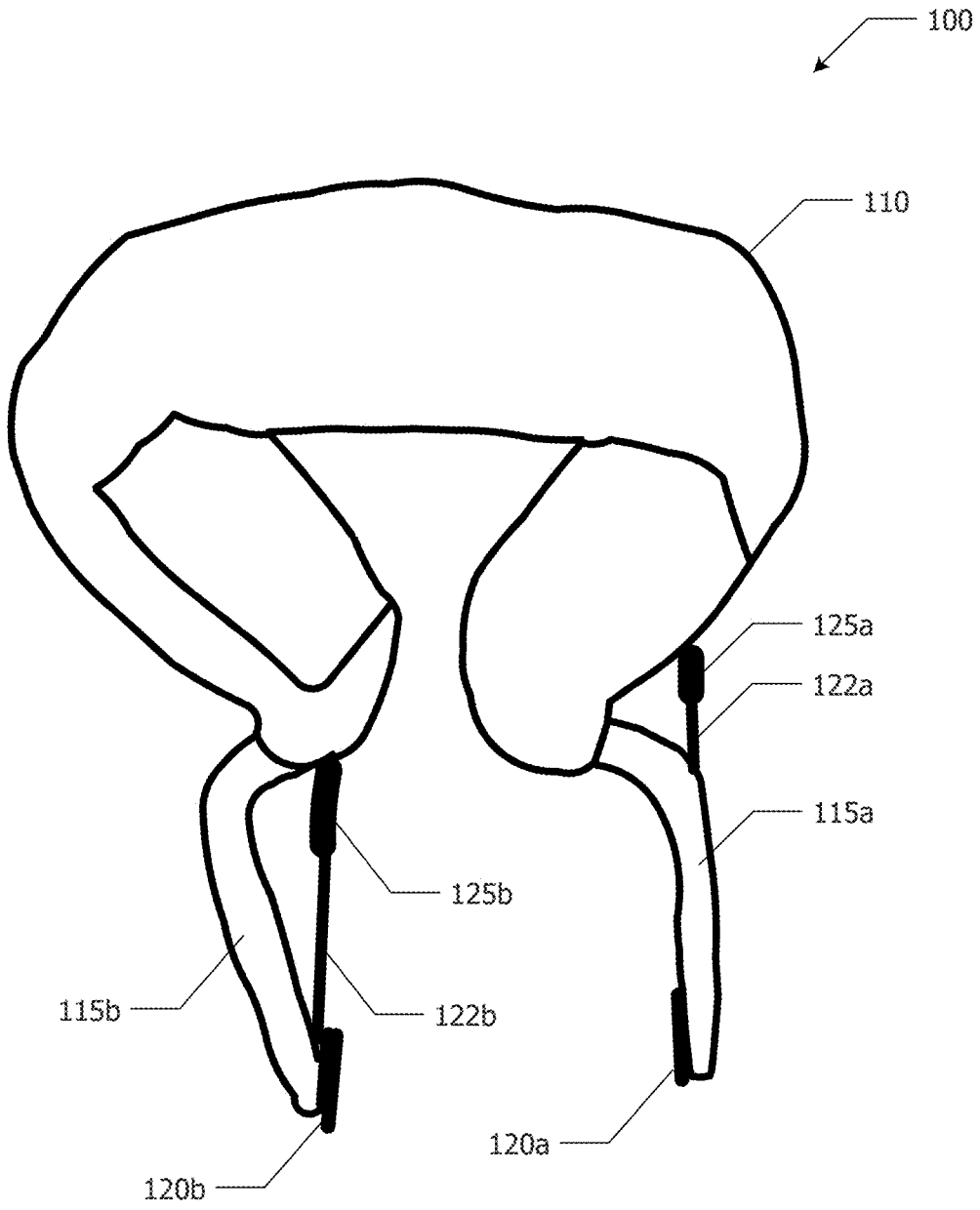
FIG. 4 illustrates an additional potential embodiment of a traveler's back view of a sleep support device that supports the upper body and head to allow comfortable sleep in a forward position during travel according to the present invention.

FIG. 4 illustrates an additional potential embodiment of a traveler's back view of a sleep support device that supports the upper body and head to allow comfortable sleep in a forward position during travel according to the present invention. This back view of the device 100 is shown in which the user is coupled with the device 100 where the user is facing forward in FIG. 4.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

What is claimed is:

1. A sleep support device for supporting an upper body and head of a traveler to allow comfortable sleep in a forward position during travel, the device comprises:

a pair of locking hinges attached to a lower end of a rigid frame;

a pair of thigh supports having an inner end coupled to the pair of locking hinges;

a pair of extension segments coupled to an outer end of the pair of thigh supports;

a first set of straps coupled to each of the pair of thigh supports;

a second set of straps coupled to each of the pair of extension segments, wherein the first and the second set of straps are configured to be wrapped around a set of thighs of the traveler to secure the sleep support device to the set of thighs of the traveler when the thigh supports and extensions are positioned lateral to the set of thighs of the traveler;

an upper body component made of the rigid frame padded with foam extending upward towards a set of shoulders of the traveler to provide upper body support and the rigid frame takes the form of an arch to support at least one of a head, a forehead, and a cheek of the traveler; and a foam pad covering to allow comfort while supporting at least one of the head, the forehead, and the cheek of the traveler.

2. The sleep support device according to claim 1, wherein the locking hinges are positioned lateral to the traveler's hips bilaterally.

3. The sleep support device according to claim 2, wherein the locking hinges include locking mechanism that operates within 0° to 90° range.

4. The sleep support device according to claim 3, wherein the pair of locking hinges are locked at approximately 70° when the sleep support device is in a sleep mode.

5. The sleep support device according to claim 4, wherein the pair of locking hinges are locked at 0° when in a storage mode.

* * * * *